United States Patent [19]

Eitel et al.

[11] 3,948,076

[45] Apr. 6, 1976

[54] AUTOMATIC PROCESS AND ALIGNING APPARATUS HAVING A PLURALITY OF ALIGNING STATIONS

[75] Inventors: Hans-Georg Eitel, Ettlingen; Waldemar Morlock, Karlsruhe-Rintheim; Dieter Ruf, Karlsruhe, all of Germany

[73] Assignee: Eitel KG., Werkzeugmaschinenfabrik, Karlsruhe, Germany

[22] Filed: Sept. 17, 1974

[21] Appl. No.: 506,728

[30] Foreign Application Priority Data

Sept. 17, 1973 Germany ..... 2346796

[52] U.S. Cl. ..... 72/384; 29/6; 72/7; 72/12; 72/389; 72/702

[51] Int. Cl.[2] ..... B21D 17/02

[58] Field of Search ..... 72/10, 11, 12, 7, 380, 72/389, 702, 30, 384; 29/6

[56] References Cited

UNITED STATES PATENTS

| | | | |
|---|---|---|---|
| 3,459,018 | 8/1969 | Miller | 72/14 |
| 3,481,170 | 12/1969 | Galdabini | 72/11 |
| 3,713,312 | 1/1973 | Galdabini | 72/389 |

FOREIGN PATENTS OR APPLICATIONS

| | | |
|---|---|---|
| 1,061,156 | 7/1959 | Germany |
| 1,169,256 | 4/1964 | Germany |

*Primary Examiner*—Milton S. Mehr
*Assistant Examiner*—James R. Duzan
*Attorney, Agent, or Firm*—Finnegan, Henderson, Farabow & Garrett

[57] ABSTRACT

Method and apparatus for automatically straightening elongated and at least partly rotationally symmetrical workpieces by applying a sequence of straightening strokes to a workpiece at each of a plurality of straightening stations to counteract a deformation until the measured instantaneous values of the deformation fall within a predetermined deformation tolerance. The depth of the straightening strokes is determined by the difference between the measured instantaneous values of the deformation and the mean of the maximum and minimum values of the deformation.

14 Claims, 3 Drawing Figures

Figure 1:
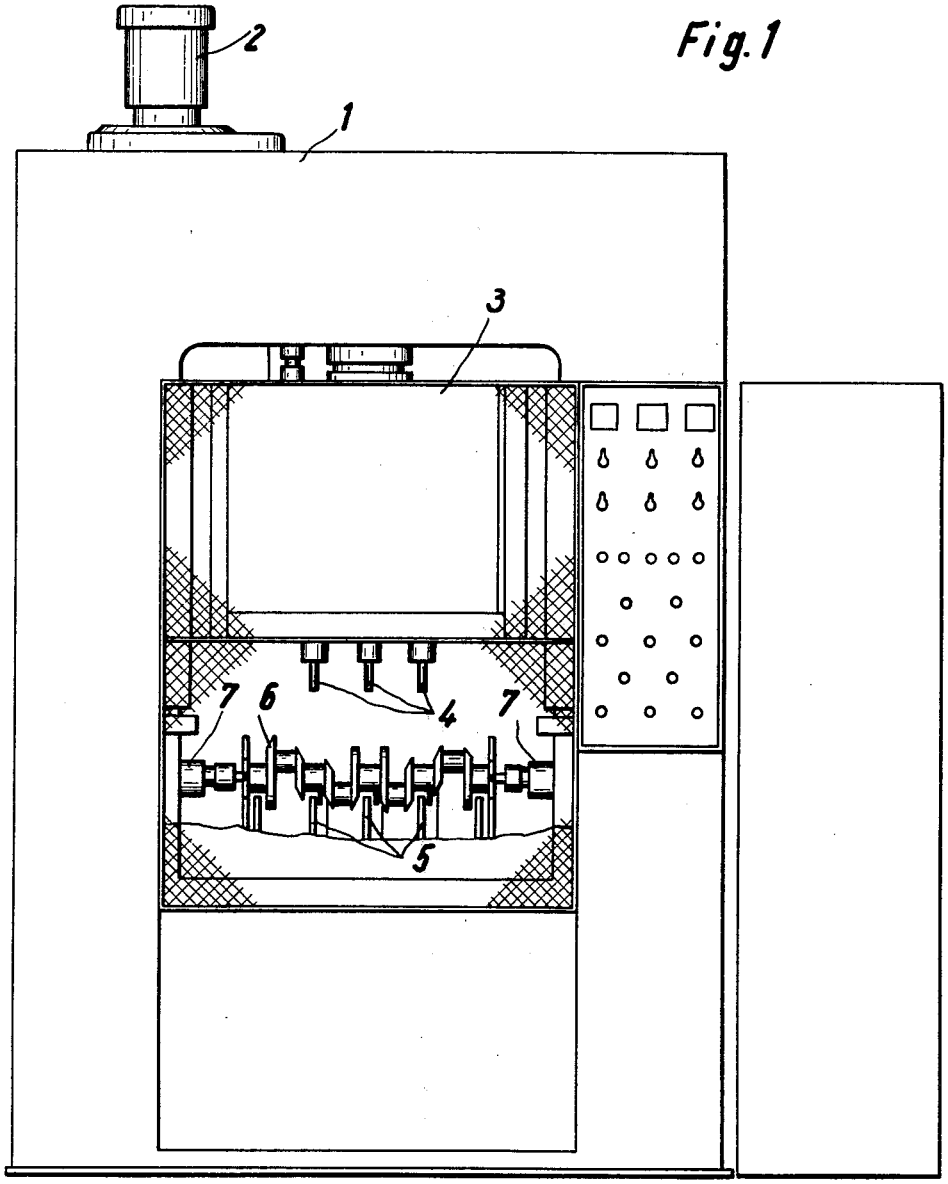

101
102
103
104
3
4
5
6
7
8
9
106
107
110
111
115
120
125
130
135
140
145
150
155
160
1
2
3
4
5
6

AUTOMATIC PROCESS AND ALIGNING APPARATUS HAVING A PLURALITY OF ALIGNING STATIONS

The invention relates to a process for the automatic straightening or alignment of elongated, and at least partly rotationally symmetrical workpieces, wherein a sequence of straightening strokes is applied to the workpiece, in a direction opposite to its original bending or deformation at a plurality of aligning or straightening stations after the deformation of the workpiece has been detected. The depth of the straightening stroke is varied in dependence on the measured instantaneous value of the deformation until the value falls below a predetermined tolerance. The invention also relates to an automatic aligning or straightening machine for carrying out this process, the straightening machine having a plurality of straightening stations, including a drive element on which a number of elements applying an straightening force are carried and having a plurality of straightening supports and measuring devices.

The straightening of elongated and at least partly rotationally symmetrical workpieces, such as shafts, for example, axle shafts, gearshafts, camshafts, crankshafts, or the like, and also bolts, axles, spindles, tubes, or the like, which as the result of heat treatment or of machining or non-cutting processing undergo deformation (i.e. in particular a deviation from the strictly straight shape transverse to the central axis of the workpiece), has hitherto been effected mainly in hand-operated aligning presses. Such a press is shown in German Patent Specification No. 1,169,256.

Straightening machines are also known (see the publication "Hubgesteuerte Richtmaschinen" by Eitel KG, Karlsruhe 1972), which have a plurality of straightening stations for each of which there is provided a separate straightening hook with a hand operating lever for controlling the straightening stroke and for adjusting the depth of stroke (by turning the lever handle), a removable straightening support, and a measuring device sensing the work-piece from below and remaining permanently in engagement with the workpiece. For this purpose, the workpieces are clamped between co-rotating centres or centering cones, which may optionally be replaced by roller holders.

Straightening machines of this kind are particularly used in timed transfer or production lines, for example for the machining of crankshafts. In these machines the timing of the necessary straightening operations are determined by the timed cycle of the transfer line. For example, these operations comprise in the production of crankshafts: 1. straightening of blank; 2. straightening after the turning of the main bearing; 3. straightening after the milling of the connecting rod bearings; 4. straightening after hardening; and 5. straightening after final grinding.

A method of aligning or straightening elongated workpieces is also disclosed by German Specification No. 1,627,511, in which at a single straightening station a sequence of shaping operations is applied to the workpiece to counteract its original deformation or sag. The workpiece is subjected to a first working stroke which deforms the workpiece beyond the completely straight shape, the excess deformation corresponding approximately to the elastic deflection Fp which can be applied to the workpiece without any part thereof exceeding the elastic limit and passing into the plastic range. After this step, the deforming force is removed and the remaining eccentricity E1 is measured. A second working stroke follows for the purpose of effecting, beyond the completely straight position, a deflection which is equal to Fp + E1, whereupon once again the deforming force is removed and the eccentricity E2 now remaining is measured. Further working strokes are performed in order to bring about a deflection Fp + E1 + E2 etc., until the remaining deviation En is below a determined value. According to an alternative this process can be simplified, with some sacrifice of accuracy, by assuming a constant average value for E1, E2 and E3.

For the method described above there is also shown a straightening press having one straightening station in the same German Specification No. 1,627,511. The press has a press piston with an adjustable working stroke, supporting devices for the workpiece and at least one device for measuring or recording the deformation or deflection of the workpiece. A control device is provided which in a first deforming operation brings about a deformation or deflection of the workpiece undergoing straightening, this deformation or deflection exceeding the zero deflection position by the extent of the elastic deflection. The control device also ensures that in the subsequent deformation or working operations a deflection occurs which in every case is equal to the deviation from the zero line which still exists at the end of the preceding operation, plus the elastic deviation. For this purpose there is also provided an electronic programming device to which the value of the elastic deviation and that of the deviation permissible at the end of the straightening operation can be fed, together with signal connections between the programming device, the device for measuring or recording the deflection, and the electro-hydraulic power device for the aligning press, the control device producing a control or operating signal for the deformation or working operation which is to be carried out by the aligning press on each occasion. The measuring device is mounted rigidly on the table of the straightening press as can be seen in the drawing of German Specification No. 1,627,511. In a practical construction of this straightening press (see GB publication "Machinery and Production Engineering", 10th May, 1972, Page 18) an aligning carriage travels in the axial direction of the workpiece for the purpose of moving the workpiece to a loading and unloading station. This carriage must also move for the purpose of moving from one straightening station to another.

Automation of the straightening process described above cannot be achieved satisfactorily for numerous reasons.

1. The value of the elastic deflection of deformation which is to be fed to the programming device must in fact be determined empirically. This gives rise to difficulties, since this elastic deflection depends on the material of the workpiece, on the resistance and moment of inertia of the workpiece at the respective straightening station, and on the distance between supports holding the workpiece during the straightening operation.

The need for the operator of the press to determine the value of the elastic deflection is particularly disadvantageous when the straightening press must be frequently reset for different workpieces. However, even for a large number of identical workpieces at the same straightening station the elastic deflection is not constant, but varies because of variations in the material, in the heat treatment, or in other preparatory treatment.

2. In order to avoid overbending, that is, excessive deflection to a bend of the workpiece with the opposite sign, in the first working stroke of the straightening press, the value of the elastic deflection which is to be fed to the programming device must be kept so low that overbending will not occur even in the most unfavorable case. This in turn, however, is particularly disadvantageous in the series production of workpieces because the number of working strokes and consequently the straightening time must be increased.

3. A large number of working strokes are necessary, since even in the final phase of the straightening operation the increases of stroke depth become increasingly small.

4. Since the measuring device is mounted rigidly on the table of the straightening press, thermal or mechanical variations or wear of the workpiece support, of the press table, and/or of the straightening punch impair the accuracy of the straightening operation, that is to say the operator must often readjust the measuring device.

5. Because the workpiece is advanced and removed axially, relatively long pauses occur between the straightening of successive workpieces, which is particularly detrimental in series production (for example in motor vehicle construction).

Recently the inventor of the straightening press described above and shown in German Specification No. 1,627,511, disclosed another straightening press construction based on the same working principle (see U.S. Patent Specification No. 3,713,312), in which a first sequence of working strokes of increasing depth are separated by a constant increase, whereupon a second series of working strokes, likewise of increasing depth, have a constant increase which is smaller than in the first series. This construction was intended to simplify the control of the press.

However, this straightening press construction continues to have the same disadvantages 1 to 5 set forth above.

Finally, there is shown by German Patent Specification No. 1,061,156 a device for the automatic straightening of shafts, pipes, or the like, which are clamped between centres or the like so as to be rotatable, or for the elimination of unbalance through a plurality of successive straightening operations by means of one or more straightening blows and by the aid of sensing stations which lie in one plane, spaced along the axial direction. Each station is provided with a storage element consisting of a rotary rheostat with dial gauge and sensing pin with brake. These storage elements determine and store the deflection in a first rotation of the workpiece, and, through a switch device, locate the position of the maximum deflection or deformation, adjust the angular position of this point through the further turning of the workpiece until it comes under the relevant straightening blow, and trigger the effective straightening stroke. To be more precise, only that straightening blow which is at the point of maximum deflection or deformation will press against the workpiece, while the others will remain out of contact. After the point where the greatest deflection has been found and has been straightened, the same operation is automatically repeated at the point where the next greatest deformation occurs until the workpiece has been completely straightened.

This straightening machine described above, however, has never been built, since it was found too expensive. More specifically, a disadvantage of this machine is that straightening would be effected at the point of maximum deformation. In addition, the stored maximum value of the deformation must be approached again in order to position the bend of the workpiece upwards. However, because of fluctuations of the height of the centres (the centres are spring-mounted), this value is generally not reproducible, so that the accuracy of straightening is appreciably reduced. Furthermore, the workpiece must be turned 360° in order to measure the deformation after the straightening stroke, so that the time required for straightening is increased. In addition, the depth of stroke stored by the rotary rheostat decreases with decreasing deformation, so that obviously the deformation cannot be completely removed. Furthermore, no disclosure is made regarding the construction of the adjustment measurement or of tolerance adjustment. Finally, the proposed positioning of the straightening supports by means of wedge slides is expensive.

The primary objects of this invention therefore consist in providing an automatic method of straightening and an automatic straightening machine having a plurality of straightening stations for the performance of the method, which are to a very large extent automated, that is, work without elastic deflection being determined empirically, and which, particularly through the elimination of the determination of the elastic deflection, also have a shorter straightening time for each workpiece, while the accuracy of straightening of the straightening machine is independent of mechanical and thermal variations in the elements applying the straightening force and in the straightening supports, that is, the machine requires no readjustment.

According to the invention, the following process steps are carried out at a first straightening station: for the determination of the deformation the workpiece undergoes one full revolution, the maximum value and minimum value of the deformation which are thereby ascertained are stored and the mean value of the deformation is determined from them; thereupon the workpiece is rotated further and the deformation values now occurring are compared with the mean value in order to detect a change of sign of the difference between the mean value and the instantaneous values of the deformation after determination of the change of sign the workpiece is further rotated until the bend of the workpiece bends outwardly towards the straightening force and then the instantaneous value of the deformation is compared with the mean value in such a manner that when the straightening or deformation tolerance is exceeded the first straightening stroke is triggered with a depth of stroke such that the element applying the straightening force is brought close to the workpiece or already acts on the latter; after the first straightening stroke has been made the instantaneous value of the deformation is again measured and compared with the mean value in such a manner that when the straightening tolerance is again exceeded a second straightening stroke is performed, the depth of which in relation to the first straightening stroke is increased by the last measured difference between the instantaneous value and the mean value of the distortion; and straightening strokes with correspondingly adjusted depth of stroke then follow until the deviation between the instantaneous value and the mean value of the distortion lies within the straightening tolerance; and the process steps carried out at the first straightening station are substantially repeated at the other straightening stations.

The method of straightening of the invention thus does not necessitate the determination of elastic deflection and the performance of the straightening process requires no special knowledge of empirical calculations.

If the deformation of the workpiece is relatively great at least one of the straightening stations, it is advisable for straightening to be first effected to a preliminary tolerance at all of the straightening stations, whereupon straightening to a final tolerance is effected at all of the straightening stations.

Otherwise, straightening at the straightening station with considerable deformation could destroy the accuracy of the deformation tolerance previously achieved at other straightening stations, because of the greater straightening force applied.

In addition, when the difference between the mean value and the instantaneous value of the deformation of the workpiece has a negative value in any straightening station, and if at the same time the deformation tolerance is exceeded, it is advantageous to turn the workpiece with its curvature directed towards the straightening force, and for the depth of the first stroke at the straightening station in question to undergo a decrease substantially equal to the deformation tolerance in the case in question.

According to the invention therefore, in contrast to the known method described above, in German Specification No. 1,627,511, overbending is in principle not detrimental to the straightening operation.

Furthermore, it is preferably for the depth of stroke of the first straightening stroke at each straightening station to be substantially equal to the distance between the element applying the straightening force, when this element is in its starting position, and the centre axis of the workpiece minus the radius of the latter at the respective straightening station.

In a further development of the invention, starting from the second or a later straightening stroke in each straightening station, the depth of stroke is additionally subjected to an adjustable minimum increase substantially equal to the deformation tolerance in each particular case.

The provision of a minimum increase provides the advantage that the variation of the depth of stroke at the end of the straightening operation, that is, for the last straightening strokes, is not too small since otherwise the number of straightening strokes and hence the time required for the straightening operation would become relatively great.

In another development of the invention the rotational speed of the workpiece is adjustable for the purpose of determining the deformation. In this way a rotational speed corresponding to the amount of inertia of the workpiece can be adjusted.

If the workpieces to be straightened in succession are identical, it is preferred that the depth of stroke of the first straightening stroke for any workpiece be made equal at each straightening station to the depth of stroke of the last straightening stroke performed in the same straightening station for the immediately preceding deformation workpiece.

In this way a considerable shortening of the straightening time is achieved, since it can be assumed that the deformation for identical workpieces is approximately equal, so that even the first straightening stroke for the second and subsequent workpieces largely eliminates the deformation. Furthermore, mechanical and thermal variations of the elements applying the straightening force, of the machine column, of the straightening supports, and so on, no longer constitutes sources of error. This is accomplished because the preceding workpiece determines the depth of stroke and any variation of these parameters after the straightening of the preceding workpiece is likely to be extremely small.

In this way any gradual variations in dimensions which may occur in the diameter of various workpieces of a series are also automatically compensated, so that the straightening time is not lengthened nor is the accuracy of straightening impaired through variations in diameter.

The automatic straightening method of this invention therefore goes through a process of self-adjustment or control.

It is obvious that this further development of the invention is of very great advantage, particularly in series production. Thus the straightening process of the invention is particularly suitable for automatic straightening presses used in automatic production lines or automated transfer lines.

However, it may also be advisable in series production for the depth of stroke of the first straightening stroke for the workpiece in question at each straightening station to undergo a second adjustable decrease, which is substantially equal to the sum of the deformation tolerance and the diameter tolerance of the workpiece.

This step provides the further advantage of avoiding the overbending of the workpiece through the first straightening stroke.

Since in the straightening operation it is not possible to prevent entirely an increase of the deformation in another radial direction of the workpiece, it is advisable to turn the workpiece another complete revolution at each straightening station after it has been found that the deviation between the instantaneous value of the deformation and the mean value lies within the deformation tolerance, in order to verify whether the difference between the mean value and each instantaneous value of the deformation lies within the deformation tolerance.

In addition, after a predetermined straightening time at one of the straightening stations or a predetermined deformation at one of the straightening stations has been exceeded, it is advisable for the respective workpiece to be sorted out or marked.

In this way a determined cycle time can be maintained when the workpiece is processed in an automatic production line, so that optimum use is made of the latter, that is, to prevent idling of the other machine tools in the production line.

In order to reduce the idle machine times during straightening, particularly when the process is applied to an automatic production line, it is advisable for the workpiece to be supplied and removed transversely to its axial direction.

The automatic straightening machine has a plurality of straightening stations for carrying out the method of the invention, a drive element on which a number of elements for applying a straightening force are mounted, and a plurality of straightening supports and measuring devices, and is characterised in that the elements for applying a straightening force are mounted on the drive element for sliding in the longitudinal direction of the workpiece and are adapted to be brought automatically into engagement with the latter, and that the straightening supports can be moved in and out in a freely selectable manner. In this way a rapid change of straightening stations and short resetting times are made possible.

Preferably, workpiece holders are provided to clamp the workpiece which are adapted to be raised against a fixed stop, for the purpose of measuring the deformation to a measuring position in which the workpiece holders are rotatably driven by a motor, and adapted together with the workpiece, to be lowered onto the straightening supports before or on the triggering of the next straightening stroke.

This arrangement provides the advantage that, through the application of the workpiece holders against the fixed stop, the workpiece is always raised into the same measuring position in order to be able to make comparative measurements after the straightening strokes. This enables the time-consuming turning of the workpiece for the formation of the mean value after each straightening stroke with a view to checking the result of the straightening operation to be dispensed with.

Figure 2:
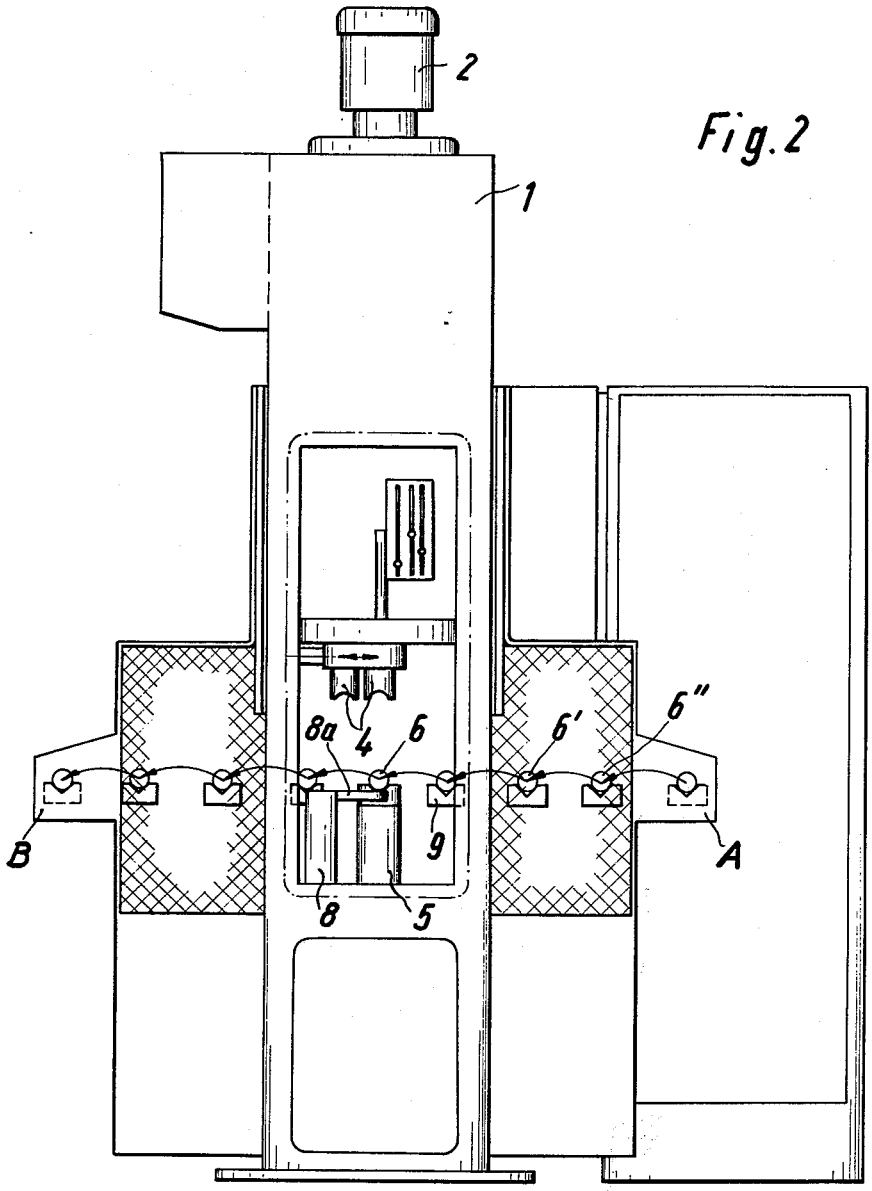
Figure 3:
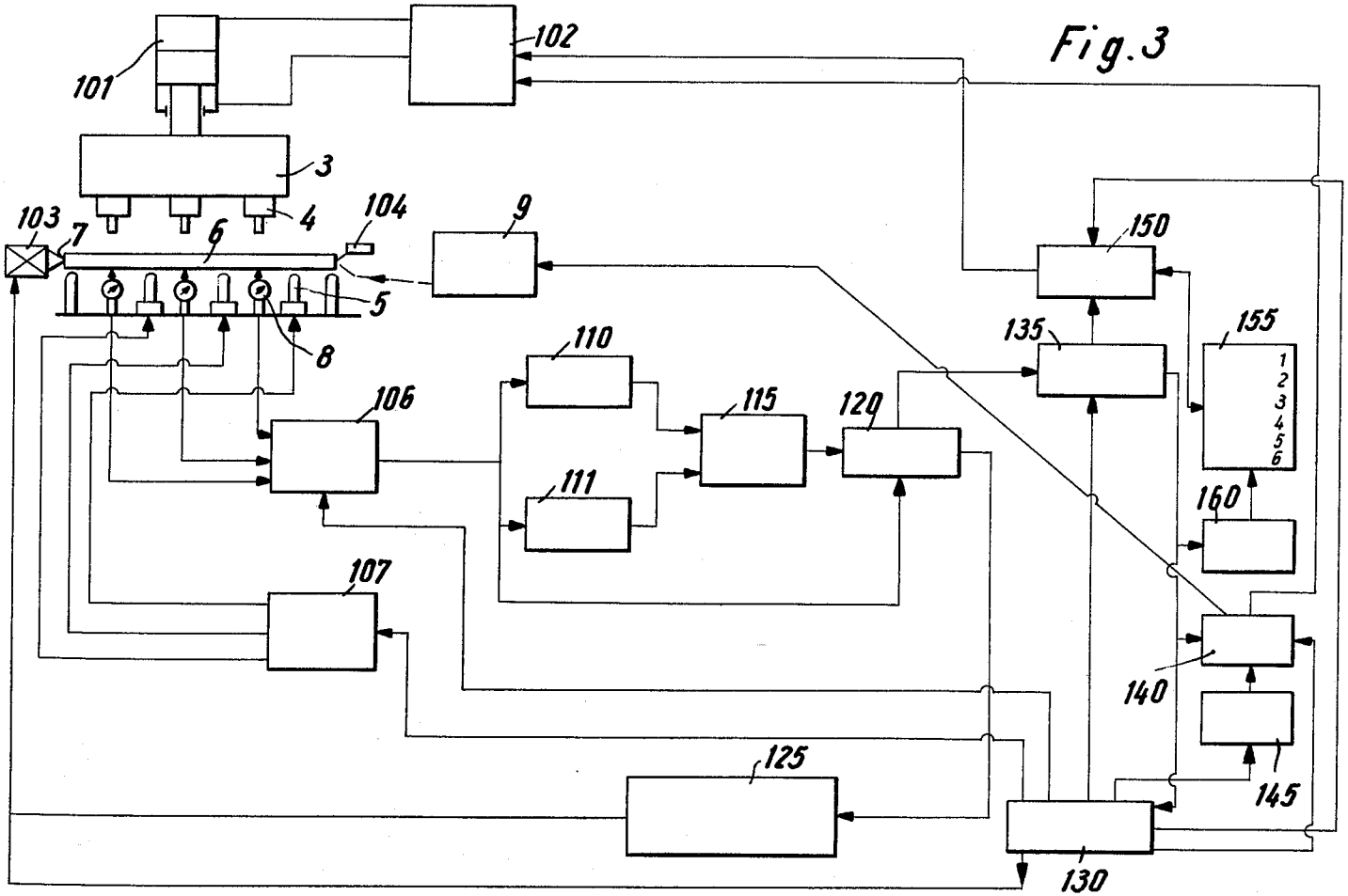

The invention is explained more fully with the aid of the drawing, in which:

FIGS. 1 and 2 are respective front and side views of one example of an automatic straightening machine constructed in accordance with the invention, and FIG. 3 is a block circuit diagram of one example of an electronic control arrangement for the automatic straightening machine.

According to FIG. 1, a C-shaped machine column 1, provided with a drive motor 2, carries a vertically movable ram 3 on which straightening punches 4 are adapted to move in the horizontal direction (see direction of arrow) in order to come, as desired, into a position opposite a gap between two of a plurality of supports 5 which carry a workpiece 6 (shown as a crankshaft in FIG. 1) during the actual straightening or aligning operation.

The workpiece 6 is held in two workpiece holders in the form of rotatably mounted center sleeves or center holders 7 which are adapted to be rotated by a motor 103 (see FIG. 3) and are able to lift the work-piece 6, by means of a cylinder (not shown), into a measuring position against a stop 104 (indicated diagrammatically in FIG. 3), while a measuring device 8 provided with a measuring lever 8*a* (see FIG. 2) measures the deformation or misalignment of the workpiece 6 at the respective station when the workpiece is turned by the center sleeves 7.

The straightening stations or the selection of the straightening supports, and the sequence of the straightening stations are adjusted as desired by means of controls 107 and 106 (see FIG. 3).

In addition, instructions can be given for a checking rotation to be made at the end of the straightening operation, and optionally for further straightening to be effected.

For workpieces in which the deformation or bending is great it is possible for straightening to be first effected to a preliminary tolerance and then to a final tolerance. The preliminary and final alignment tolerances for each straightening station are freely adjustable.

As FIG. 2 shows, a series of workpieces 6, 6′, 6″, etc., which are to be straightening one after the other, are transported perpendicularly to their axes by a stepping workpiece transport device 9 (also shown in FIG. 3) automatically through the straightening machine, from a loading station A to an unloading station B, in dependence on the time. The workpieces 6, 6′, 6″ are not axially displaced, even in the straightening station where the straightening operation is carried out. The introduction and removal of the workpieces 6, 6′, 6″ in a direction perpendicular to their axes instead of along their axes entails only a very slight loss of time for the change of workpiece, so that the automatic straightening machine is particularly suitable for automated transport lines with a short cycle time.

The automatic straightening machine is particularly suitable for use with a production line. The operation begins as soon as a workpiece is placed in the straightening station.

It is advantageous for the straightening time to be limited by an adjustable time limiting element 145 (see FIG. 3), in order to maintain a predetermined cycle time, since excessive straightening times could occur because of surface defects or non-circularity of certain workpieces, such as shafts. If the predetermined straightening time is exceeded, this workpiece is sorted out or marked.

The construction of the electronic control part is shown in a simplified and clear manner in FIG. 3, so that here again repetition is not necessary.

The straightening machine of this example works in the following manner. The measuring device 8 at the particular straightening station, which is selected in each case by a control panel 130 with the aid of the command transmitter 106 for the sequence of straightening stations, measures the deformation 6 during the rotation of the workpiece by the motor 103 operating under the control of the control panel 130. The maximum and minimum values of the deformation are stored in stores 110 and 111 (see FIG. 3), the arithmetic means being calculated therefrom by addition followed by division by two in a mean forming unit 115 (see FIG. 3). This mean value is automatically compared with the instantaneous value of the deformation in a first comparator 120 (see FIG. 3). As soon as this difference is zero and its sign changes from minus to plus, the motor 103 turns the center sleeves 7, and consequently the workpiece 6, through a further angle of 90°, due to a control signal from a transmitter 125, so that the bend of the workpiece faces upwards towards the straightening punch 4 in the respective straightening station. In this position the difference between the instantaneous value and the mean value of the deformation is again determined in the first comparator 120, and then compared in a tolerance comparator 135 with a deformation tolerance, which may be a preliminary deformation tolerance, that is fed in from the control panel 130 for the respective straightening station. If the difference is greater than the deformation tolerance, a straightening operation is carried out. In this event the tolerance comparator 135 gives the appropriate order for the adjustment of the depth of stroke, in accordance with the measured difference, to an adjusting signal transmitter 150, to which if desired, data regarding minimum stroke increase or decrease can also be given from the control panel 130. The control signal transmitter 150 in turn controls an electro-hydraulic drive 102 for the straightening cylinder 101.

The electro-hydraulic drive 102 has an electric adjusting drive (not shown), which is operated directly by the adjusting signal transmitter 150 and in turn controls through a control member (not shown) a control slide valve (not shown) which adjusts the flow of pressure medium for the operation of the adjusting ram in the adjusting cylinder 101. At the end of the straightening stroke the flow of pressure medium is interrupted by means of a switch stop (not shown) moving in synchronism with the adjusting ram and consequently with the adjusting punch 4 in the respective straightening station. This switch stop returns the control slide valve to the starting position by way of the control member, for the purpose of stopping the straightening punch 4. In this connection reference is made to the previously mentioned German Patent Specification No. 1,169,256. Although it shows a manually operated hydraulic aligning press, the reference nevertheless has a drive for the aligning ram which is substantially the same as the example described here. However, the difference in that case is that the control member is adjusted by hand, whereas in the present case the electric adjusting drive is provided and is operated by the adjusting signal transmitter 150.

After the straightening stroke has been made the center sleeves 7 are again raised to the measuring position against the fixed stop 104, and the difference between the instantaneous value and the mean value of the deformation is again compared with the deformation tolerance in the tolerance comparator 135. If the deviation is still too great, the straightening punch 4 must make a deeper stroke in the respective straightening station. For this purpose the adjustment signal transmitter 150, with the aid of the electric adjusting drive, adjusts the control member of the control slide valve in the electro-hydraulic drive 102 in such a manner that the switch stop of the straightening punch 4 reaches the control member somewhat later (see also the previously mentioned German Patent Specification No. 1,169,256). Thus the depth of stroke increases by an amount derived from the residual error and any adjustable minimum increase which may take into account the geometrical shape of the workpiece.

Straightening operations and increase of stroke are repeated until the deformation is within the deformation tolerance. This depth of stroke at the respective straightening station, which may be less the adjustable decrease, is stored by way of a storage selector 160 in a separate depth of stroke store 155 (shown in FIG. 3 with storage spaces for six straightening stations), in order to ensure that the next identical workpiece will be straightened with this depth of stroke in the same straightening station, if it requires straightening.

After the tolerance comparator 135 has determined that for all the straightening stations the measurement is correct with respect to the final deformation tolerance, or that a predetermined maximum straightening time fed into the straightening time limiting unit 145 from the control panel 130 has expired, an "end of program" is signalled by a workpiece change command transmitter 140 (which may also be operated directly from the control panel 130) which causes the straightening ram 3 and consequently the straightening punch 4 to travel a selectable distance upwards in order to permit the transport of the workpiece. This also operates the workpiece transport device 9 (indicated diagrammatically). At the same time the center sleeves 7 fall and release the workpiece 6, so that the latter rests freely on the fixed straightening support 5 for further transport.

For transport purposes all the workpieces 6, 6′, 6″ (see FIG. 2) are advanced one step by the workpiece transport device 9. If within the adjusted straightening time the workpiece has been straightened with the necessary accuracy, it remains in the following station, otherwise it is marked or sorted out.

The newly inserted identical workpiece is clamped, raised, etc. as previously described, but in the individual straightening stations, the workpiece is immediately straightened with the stroke depth values last fed in for the preliminary straightening and final straightening.

After the tolerance comparator 135 has verified correct dimensions in the first straightening station, the control panel 130 and command transmitter 106 effect the transfer to the second straightening station, that is, the relevant straightening punch 4 and the relevant straightening supports 5 move above and below the workpiece respectively at the second straightening station. The steps of the process described for the first straightening station then take place at the second station.

After all the workpieces requiring straightening have been straightened to the relevant preliminary deformation tolerance, the control panel 130 switches over to final straightening tolerance and the steps of the straightening process described above are repeated in the same sequence of the straightening stations, with the tolerance comparator 135 now applying the final straightening tolerance.

In the case of larger permissible tolerances it is naturally possible to eliminate preliminary straightening (for example by operating a selector switch (not shown) on the control panel 130) in order to achieve shorter straightening times.

The accuracy of straightening achieved can now be checked if desired (for example by operating a switch) by a very fine measurement controlled by the control panel 130 with a complete revolution of the workpiece. If necessary, further straightening then follows.

The newly inserted workpiece is clamped, raised, etc. as previously described, but is now straightened immediately with the stored values or stroke depths for preliminary straightening and final straightening.

If the comparator 120 should detect overbending after any straightening stroke, that is, a negative sign of the difference between the new value and the instantaneous value of the deformation of the workpiece, this difference is nevertheless transmitted to the tolerance comparator 135. If the difference lies within the predetermined deformation tolerance, nothing is changed in the process described above. If however the value is greater than the deformation tolerance, the tolerance comparator 135 will on the one hand transmit through the control panel 130 a decrease signal to the adjusting signal transmitter 150, and on the other hand will restart the straightening process, that is, beginning with a full revolution of the workpiece and storage in the stores 110 and 111 of the maximum and minimum values of the deformation thus measured.

What we claim is:

1. A process for automatically straightening elongated and at least partly rotationally symmetrical workpieces, including the application of a sequence of straightening strokes to a workpiece at each of a plurality of straightening stations to counteract a deformation comprising the steps of:

a. rotating the workpiece through a full revolution;
b. detecting the maximum value and minimum value of deformation of said rotating workpiece;
c. determining the mean value of the maximum and minimum deformation detected;
d. again rotating the workpiece;
e. sensing the instantaneous values of deformation during rotation of the workpiece;
f. comparing the instantaneous values of deformation of the rotating workpiece with the mean value to detect a change of sign in the difference between said mean value and said sensed instantaneous values of deformation;
g. positioning the deformation of said workpiece towards an element applying the straightening stroke when said change of sign is detected;
h. comparing the instantaneous value of the positioned deformation to said mean value to determine whether a preset deformation tolerance is exceeded;
i. applying a straightening stroke if said sign is positive and said deformation tolerance is exceeded, the first straightening stroke of the sequence having a depth of stroke such that the straightening element is brought close to or touching the workpiece and a susequent straightening stroke of the sequence having a depth of stroke increased from that of the previous straightening stoke by the latest measured difference between the instantaneous value of the positioned deformation and the mean value; and
j. repeating steps (h) and (i) until the deformation tolerance is not exceeded.

2. The process according to claim 1, wherein applying steps (a) through (j) to reduce said deformation to a preliminary deformation, tolerance and reapplying steps (a) through (j) to reduce said deformation to said preset deformation tolerance.

3. The process according to claim 1 further includes at each straightening station, when the difference between the mean value and the instantaneous value of the deformation of the workpiece has a negative value and at the same time exceeds the preset deformation tolerance, after step (h) the steps of repositioning the workpiece for applying the straightening strokes to the deformation; decreasing the depth of stroke by an amount substantially equal to the preset deformation tolerance; and comparing the instantaneous value of the deformation of the repositioned workpiece with the mean value.

4. The process according to claim 1, wherein at each straightening station, the first straightening stroke of the sequence in step (i) has a depth of stroke substantially equal to the distance between the element applying the straightening force when said element is in its starting position, and the center axis of the workpiece minus its radius.

5. The process according to claim 1, wherein at each straightening station, at the second or a later straightening stroke of the sequence in step (i) the depth of stroke is subject to a minimum increase substantially equal to the preset deformation tolerance.

6. The process according to claim 1, wherein the steps of rotating and again rotating includes the step of adjusting the rotational speed of the workpieces for the purpose of measuring the deformation.

7. The process according to claim 1, wherein at each straightening station, when a succession of workpieces to be straightened are identical, said first straightening stroke of the sequence in step (i) for any workpiece has a depth of stroke equal to the depth of stroke of the last straightening stroke performed on the immediately preceding straightened workpiece at the same station.

8. The process according to claim 7, wherein at each straightening station, said first straightening stroke of the sequence in step (i) for the respective workpiece has a depth of stroke decreased by an amount substantially equal to the sum of the preset deformation tolerance and a predetermined tolerance of the diameter of the workpiece.

9. The process according to claim 1, further including, at each straightening station, after step (i) the steps of rotating the workpiece through a full revolution and comparing each instantaneous value of deformation of said rotating workpiece to said mean value to determine whether the preset deformation tolerance is exceeded.

10. The process according to claim 1 further including the step of sorting out or marking of a workpiece when a predetermined time or predetermined deformation has been exceeded at any one of said straightening stations.

11. The process according to claim 1 further including the steps of supplying to and discharging from said straightening stations said workpiece transversely to its axial direction.

12. An automatic straightening machine comprising a plurality of straightening stations for applying a sequence of straightening strokes to a workpiece at each of said straightening stations to counteract a deformation, a plurality of supports for receiving said workpiece, said supports being selectively movable into and out of operating position, means for applying a straightening stroke to said workpiece, said means being adjustable in the longitudinal direction of said workpiece and automatically actuated for engagement with said workpiece, a drive element for providing an adjustable length of stroke to said applying means, a plurality of devices for measuring deformation of the workpiece, and means responsive to said sensing device for automatically actuating said drive element.

13. An automatic straightening machine according to claim 12 further comprising a fixed stop for positioning the workpiece for measurement of the deformation and holders for the workpiece, against said fixed stop, rotatable for measurement of said deformation, and movable downwardly to bring said workpiece onto said straightening supports for applying a straightening stroke.

14. An automatic straightening machine according to claim 12 further comprising a measuring device for determining the distance between said means for applying the straightening stroke, in its initial position, and the workpiece.

* * * * *

UNITED STATES PATENT OFFICE

CERTIFICATE OF CORRECTION

Patent No. 3,948,076 Dated April 6, 1976

Inventor(s) Hans-Georg Eitel, Waldemar Morlock and Dieter Ruf

It is certified that error appears in the above-identified patent and that said Letters Patent are hereby corrected as shown below:

IN THE TITLE:

After "AUTOMATIC", insert --ALIGNING--.

IN THE SPECIFICATION:

Column 4, line 50, after "mation", insert a semicolon --;--.

Column 7, line 14, after "tion", insert a comma --,--.

Column 7, line 15, after "adapted", insert a comma --,--.

Column 1, line 11, after "deformation, insert a comma --,--.

IN THE CLAIMS:

Claim 6, column 12, line 5, change "workpieces" to --workpiece--.

Claim 13, column 12, line 55, after "workpiece,", insert --said holders being movable upwardly to bring said workpiece--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*